US006578206B1

(12) United States Patent
LaBrash

(10) Patent No.: US 6,578,206 B1
(45) Date of Patent: Jun. 17, 2003

(54) PORTABLE WASTE COLLECTION DEVICE

(75) Inventor: Richard LaBrash, Salem, MO (US)

(73) Assignee: Ell-Dee, LLC, Salem, MO (US)

( * ) Notice: Subject to any disclaimer, the term of this patent is extended or adjusted under 35 U.S.C. 154(b) by 0 days.

(21) Appl. No.: 10/286,247

(22) Filed: Nov. 1, 2002

(51) Int. Cl.[7] ..... A47K 11/00

(52) U.S. Cl. ..... 4/144.1; 4/453; 4/454; 4/144.3

(58) Field of Search ..... 4/144.1–144.4, 4/114.1, 301, 309, 453, 454, 462, 463, 459; 604/317

(56) References Cited

U.S. PATENT DOCUMENTS 4,180,875 A * 1/1980 Wilson ..... 4/309
4,270,231 A 6/1981 Zint
5,329,644 A 7/1994 Scott
5,331,689 A 7/1994 Haq
5,380,289 A * 1/1995 Hemstreet et al. ..... 604/317
5,551,097 A 9/1996 Short
5,655,229 A 8/1997 Horn
5,687,429 A 11/1997 Rahlff
5,848,443 A 12/1998 Waugh
5,852,830 A 12/1998 Horn
5,926,858 A * 7/1999 Heller ..... 4/144.1
6,163,892 A 12/2000 Abbato
6,199,220 B1 3/2001 Smith
6,202,224 B1 3/2001 Freeman
6,212,691 B1 4/2001 Heberer
6,363,541 B1 4/2002 Tylka
6,370,701 B1 4/2002 Siegrist
6,374,432 B1 4/2002 Morris

* cited by examiner

*Primary Examiner*—Gregory Huson
*Assistant Examiner*—Tuan Nguyen
(74) *Attorney, Agent, or Firm*—Thompson Coburn, LLP

(57) ABSTRACT

A portable waste collection device comprises a first container and an adjacent second container. The first container has an interior volume adapted to receive and contain waste. The second container has an interior volume adapted to contain a flushing solution. The second container has a discharge port adapted to permit flushing solution contained in the second container to be discharged from the second container into the first container. The second container comprises a pump for pumping a desired amount of the flushing solution from the second container into the first container.

26 Claims, 3 Drawing Sheets

PORTABLE WASTE COLLECTION DEVICE

BACKGROUND OF THE INVENTION

The present invention relates generally to a portable waste collection device and, more particularly, to a portable, self-contained, urinal system for travel use and other situations where conventional restroom facilities are unavailable.

A common problem with travelers and others who work or recreate in confined or remote places is the lack of suitable restroom facilities. For example, members of the trucking industry often have their work interrupted by the need to urinate. Truckers must exit the road and locate rest stops or other facilities with public restrooms, which delays their travel. Also, many such truckers sleep in their-trucks at rest stops or between driving shifts. However, sleep is sometimes disturbed by a trucker's need to leave the truck to use the rest stop's restroom facilities. In both cases, the trucker must leave the truck to use the facilities.

A variety of portable urinating apparatuses have been devised to address the above-referenced problems. In many cases, truckers have used devices as simple as ajar or other container and lid combination for temporarily receiving and storing urine until the container can be emptied or disposed of later. However, this rather crude approach has a number of problems. First, there are sanitation problems, including untreated waste that may be stored inside the vehicle's cabin for several hours, not to mention the unpleasant odors resulting therefrom, as well as the issue of proper disposal. In addition, when such crude containers are used, there is a risk of spillage, especially when the vehicle is back on the road.

Therefore, a need exists for a compact, portable urinal system that is sanitary, convenient to use and spill/splash resistant.

SUMMARY OF THE INVENTION

It is in view of the above problems that the present invention was developed. In general, a portable urine collection device of the present invention comprises a first container and an adjacent second container. The first container has an interior volume adapted to receive and contain urine. The second container has an interior volume adapted to contain a flushing solution. The second container has a discharge port adapted to permit flushing solution contained in the second container to be discharged from the second container into the first container. The second container comprises a pump for pumping a desired amount of the flushing solution from the second container into the first container.

In another aspect of the invention, a portable urine collection device comprises a first container with an interior volume adapted to receive and contain urine, and a second container adjacent to the first container. The second container has a variable interior volume adapted to contain a flushing solution. The second container has a discharge port adapted to permit flushing solution contained in the second container to be discharged from the second container into the first container. The second container is operable in a manner to cause the variable interior volume of the second container to vary between a first volume and a second volume. The second volume is smaller than the first volume. The second container is operable in a manner to at least partially collapse the interior volume of the second container, which causes an amount of the flushing solution from the second container to be discharged into the first container.

In still another aspect of the invention, a method is provided for collecting urine in a portable collection device. In general, the method comprises the steps of providing a collection device having a first container and an adjacent second container; depositing urine in the first container of the collection device; and at least partially collapsing an interior volume of the second container. The first container is adapted to receive and contain urine. The interior volume of the second container is variable and contains a flushing solution. The second container includes a discharge port for carrying flushing solution from the second container into the first container. The step of at least partially collapsing the interior volume of the second container includes collapsing the interior volume in a manner to pump a desired amount of the flushing solution from the second container into the first container.

While the principal advantages and features of the present invention have been described above, a more complete and thorough understanding and appreciation of the invention may be attained by referring to the drawings and detailed description of the preferred embodiments, which follow.

BRIEF DESCRIPTION OF THE DRAWINGS

The accompanying drawings, which are incorporated in and form a part of the specification, illustrate the embodiments of the present invention and, together with the description, serve to explain the principles of the invention. In the drawings.

Figure 1:
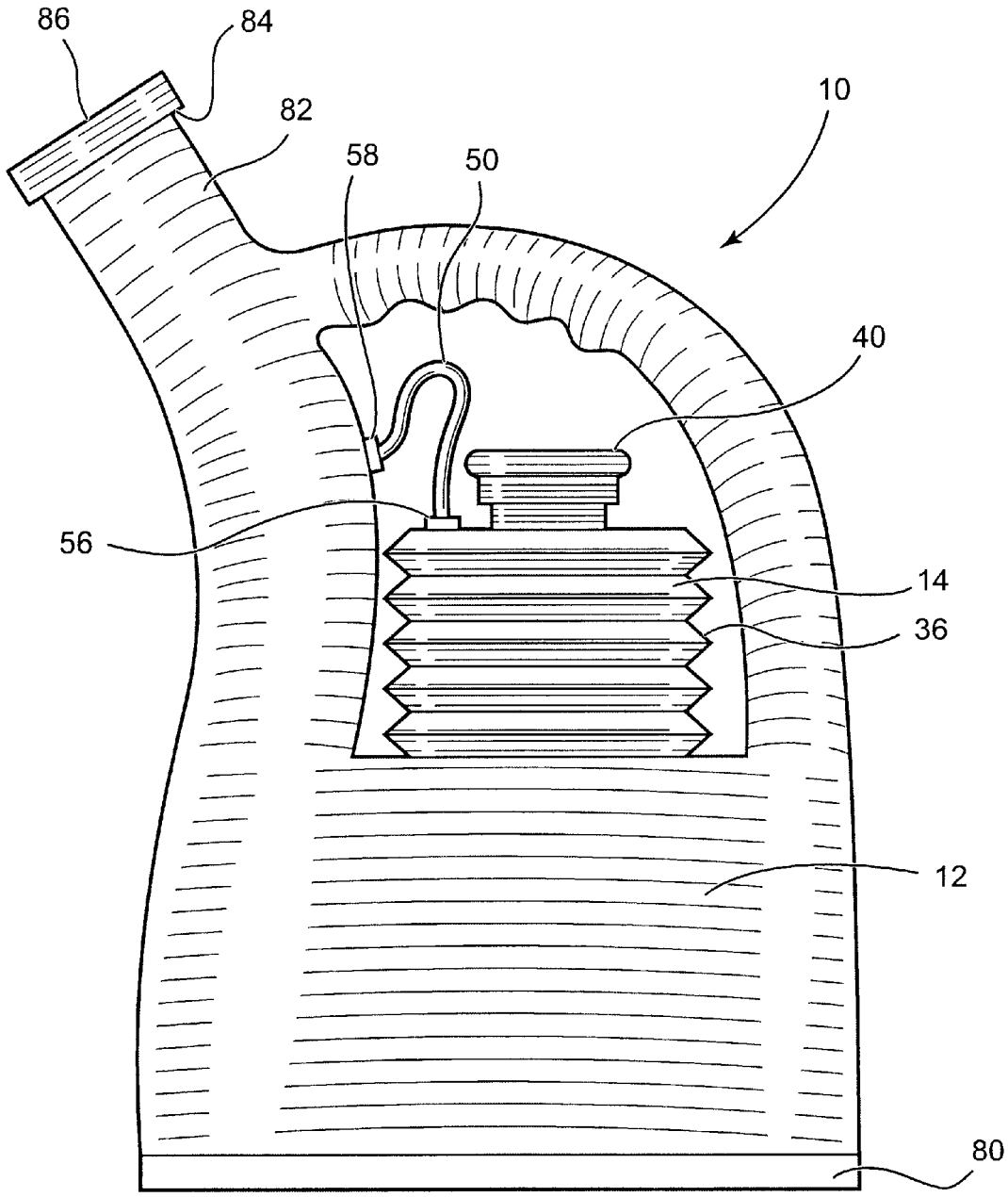
FIG. 1 is a side elevational view of a portable waste collection device of the present invention.

Reference characters in these Figures correspond to reference characters in the following detailed description of the preferred embodiments.

DETAILED DESCRIPTION OF THE PREFERRED EMBODIMENTS

A portable waste collection device of the present invention is represented in its entirety in FIG. 1 by the reference numeral 10. In general, the portable waste collection device 10 comprises a first or primary container 12 and an adjacent second container 14. The first container 12 has an interior volume 20 adapted to receive and contain urine 22 or another waste fluid. The second container 14 has an interior volume 24 adapted to contain a flushing solution 26. The second container 14 includes a discharge port 30 in fluid communication with the first container. The discharge port 30 of the second container 14 is adapted to permit flushing solution 26 from the second container 14 to be discharged into the first container 12.

Figure 2:
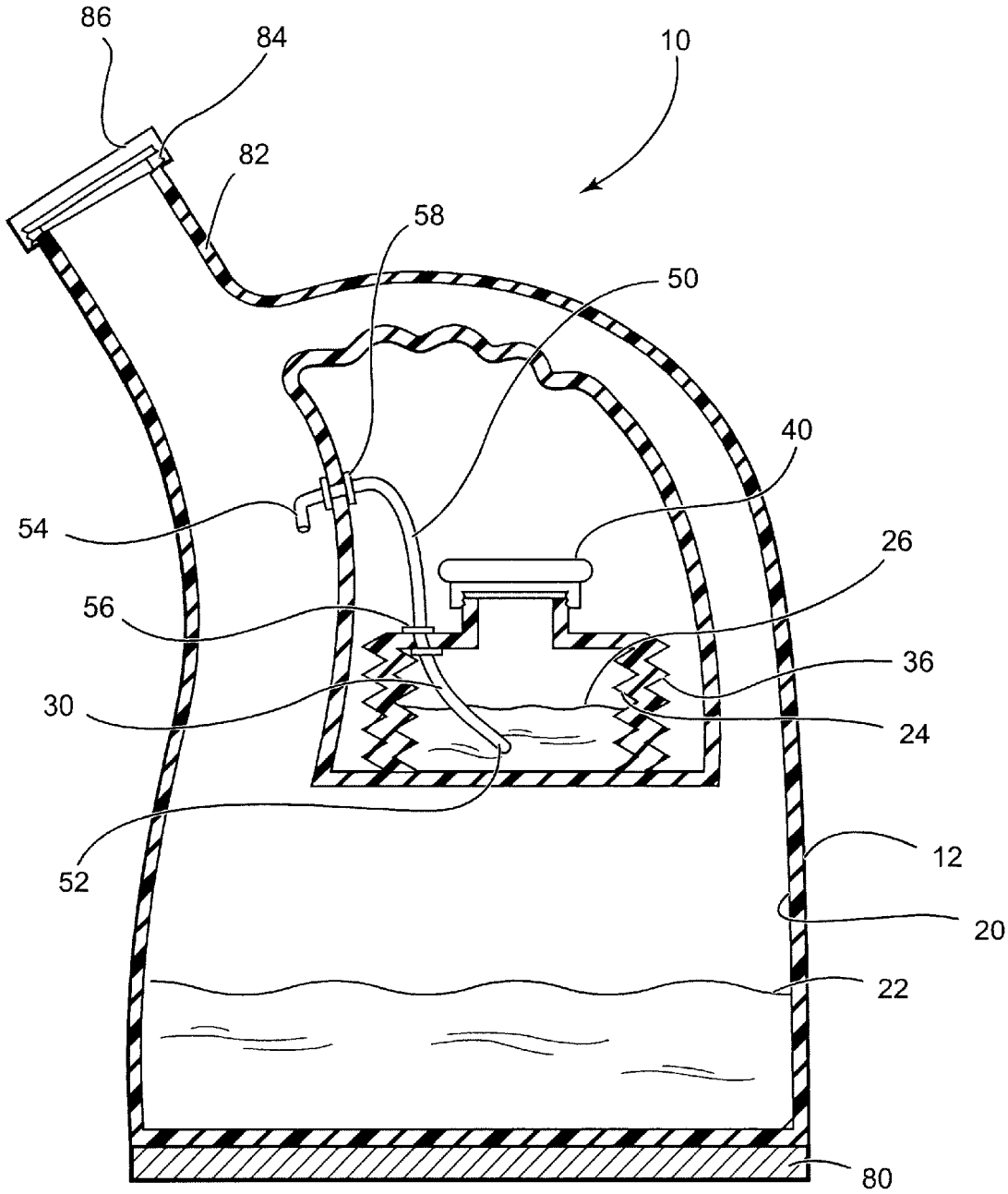
FIG. 2 is a partial cross-sectional side view of the portable waste collection device of FIG. 1.

FIG. 2 is a partial cross-sectional side view of the portable waste collection device 10 of FIG. 1. As shown in FIG. 2, the first and second containers 12 and 14 are preferably of a unitary construction, though other configurations, including multi-piece constructions, could be employed without departing from the scope of the present invention.

The second container 14 comprises a pump for pumping a desired amount of the flushing solution 26 from the second container 14 into the first container 12 via the discharge port 30. As shown in FIGS. 1 and 2, the pump preferably comprises a compressible or collapsible body portion 36 of the second container 14. Preferably, the body portion 36 of the second container 14 is compressible or collapsible in a manner to reduce the interior volume 24 of the second container 14, thereby increasing the fluid pressure inside the second container 14, which causes the desired amount of flushing solution 26 to be pumped from the second container 14 into the first container 12 via the discharge port 30. Preferably, the pump is manually operable in this manner by the user pressing downwardly on a hand-engaging portion 40 of the second container 14. As shown in FIGS. 1 and 2, the collapsible body portion 36 of the second container 14 preferably has a bellows-like configuration that facilitates the manual pumping action. In the preferred embodiment of the invention, the hand-engaging portion 40 comprises an internally threaded, removable cap 42, which is adapted for threaded engagement with an externally threaded port 44 at the upper end of the second container 14. This cap 42 can be removed to fill or empty the second container 14.

Although the preferred embodiment of the invention described above and shown in FIGS. 1–3 includes a collapsible body portion 36 having a bellows-like configuration, other pumping mechanisms for moving flushing solution from the second container 14 to the first container 12 could be employed without departing from the scope of the present invention. For example, the same function could be accomplished with a piston-like portion of the second container for similarly reducing the interior volume of the second container 14 to increase the internal fluid pressure therein and force flushing solution 26 through the discharge port 30. Another example is the type of manual pump used in gasoline siphons, which utilizes a pair of "flapper" valves. In addition, conventional pumping mechanisms found in trigger sprayers for spray bottles or hand pumps for liquid soap and lotion containers could be used to pump flushing solution 26 from the second container 14 into the first container 12 without departing from the scope of the invention.

FIG. 1 illustrates the second container 14 in a first condition (generally uncompressed), which is an equilibrium state wherein the internal fluid pressure in the second container 14 is substantially at atmospheric pressure. FIG. 2 illustrates the second container 14 in a second condition wherein the collapsible body portion 36 has been at least partially compressed or collapsed to reduce the interior volume 24, and thus increase the internal fluid pressure, which causes the flushing solution 26 to be discharged into the first container 12 via the discharge port 30. Preferably, after each pumping stroke, the body portion 36 of the second container returns (i.e., expands) substantially to the first condition, in part due to the internal fluid pressure, but also due to the resiliency of the materials that form the walls of the second container 14. Thus, in the preferred embodiment of the invention, the second container 14 has a variable interior volume 24, which varies between a first volume (illustrated in FIG. 1) and a second volume (illustrated in FIG. 2), which is smaller than the first volume. By operating the pump of the second container 14, this variable interior volume 24 is at least partially collapsed to increase the internal fluid pressure and thereby cause a desired amount of the flushing solution 26 to be discharged from the second container 14 into the first container 12.

Preferably, both the first and second containers 12 and 14 are made of a corrosion resistant polymeric material such as polypropylene, though other materials such as highdensity polyethylene (HDPE) could be used without departing from the scope of the present invention. Also, preferably, at least portions of the first and second containers 12 and 14 are translucent or transparent, so that fluid levels can be exteriorly monitored.

As best shown in FIG. 2, the discharge port 30 preferably comprises a flexible tube 50 with an inlet end 52 that lies near the bottom of the interior 24 of the second container 14 and a discharge end 54 in fluid communication with the interior volume 20 of the first container 12. A sealing member 56 secures the tube 50 in place relative to a portion of the second container 14 and ensures a fluid-tight seal. A similar sealing member 58 secures the discharge end 54 of the tube 50 to the body of the first container 12.

Figure 3:
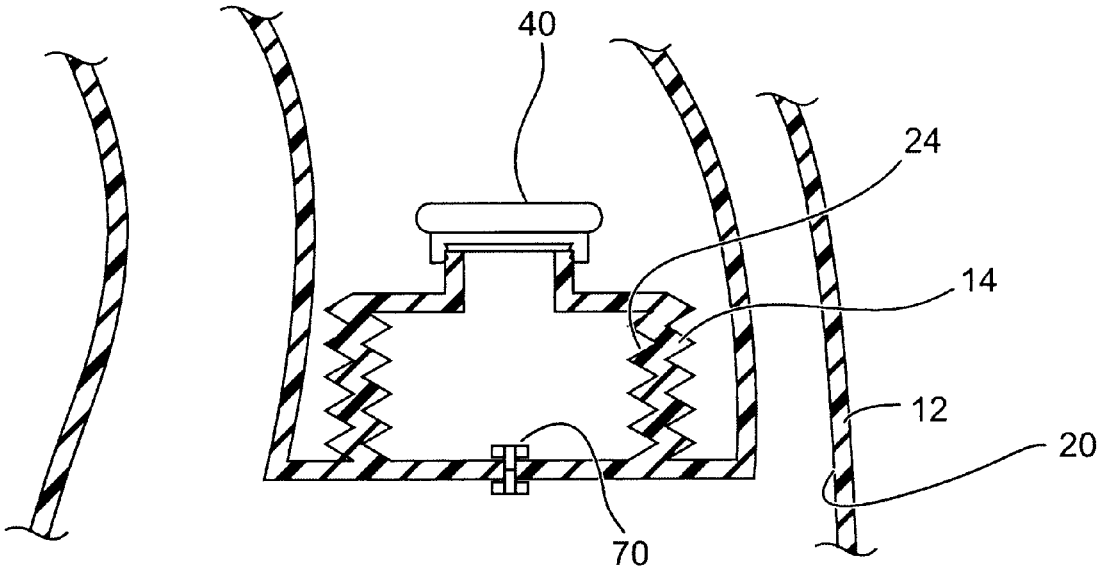
FIG. 3 is a detail view of an alternate embodiment of the portable waste collection device of FIGS. 1 and 2.

FIG. 3 illustrates an alternate embodiment of the portable waste collection device of FIGS. 1 and 2. The embodiment of FIG. 3 includes a check valve 70 between the interior volumes 20 and 24 of the first and second containers 12 and 14, which permits an amount of flushing solution 26 to be discharged from the second container 14 into the first container 12 when the interior volume 24 of the second container 14 is under pressure, and which maintains a substantially fluid-tight seal between the interior volumes 20 and 24 of the first and second containers 12 and 14 when the interior 24 of the second container 14 is at or near atmospheric pressure. In this embodiment, a second check valve (not shown) may be located elsewhere in a wall of the second container 14 to permit return air to enter the second container 14 after pumping.

Preferably, the flushing solution 26 comprises a deodorizing solution and/or a disinfectant solution. Although a variety of deodorizing/disinfectant solutions may be suitable for use in the present invention, the inventor herein has determined that a commercial product known as Simple Green®, sold by Sunshine Makers, Inc. of Huntington Harbour, Calif., is preferable for this purpose. Simple Green is an water-based all-purpose cleaner, degreaser and deodorizer that contains a blend of synthetic, high-grade penetrants that are activated by water. The product is sold in concentrated form, but may be used either undiluted or as a solution diluted in water. The inventor herein has determined that Simple Green used as a flushing solution successfully reduces or eliminates odors, renders the stored urine safe for proper disposal, and ensures biodegradability.

It has been determined that the preferred amount of Simple Green to be delivered for each "use" of the device 10 is approximately 25 ml. This is based on a typical maximum urine discharge from the human body of about 500 ml. Thus, for example, in a device 10 with a first container 12 having a capacity of about 1 gallon (3.785 liters) and a second container 14 having a capacity of about 1 quart (0.946 liters), the number of "uses" would be about 6, so at least 150 ml of Simple Green should be mixed with water (at or about a 5:3.1 ratio) to form the flushing solution. However, it should be understood that, although the inventor herein has determined that Simple Green applied in the aforementioned concentrations and amounts achieves the desired results, other mixing ratios of Simple Green (or other products altogether) could be used in the device 10 of the present invention without departing from the scope of the invention as claimed herein.

The portable waste collection device 10 also preferably comprises a generally planar metal base plate 80 connected to a lower portion of the first container 12 and being generally coextensive therewith, for providing improved stability of the collection device 10, i.e., for reducing the likelihood of tipping or spilling, by providing a low center of gravity for the device 10. However, other materials may be used to serve the same purpose without departing from the scope of the present invention. For example, a relatively heavy rubber base may serve the same purpose of improving stability and preventing tipping while also providing the benefit of a slip-resistant lower surface.

As shown in FIGS. 1 and 2, the portable waste collection device 10 further comprises an inlet conduit 82, which is in fluid communication with the interior volume 20 of the first container 12. The inlet conduit 82 is adapted for receiving urine from the user (not shown) and for conveying the same into the interior volume 20 of the first container 12. Preferably, the inlet conduit 82 is curved, to minimize backsplash during use. Preferably, an inlet end 84 of the inlet conduit 82 is externally threaded and adapted for threaded engagement with an internally threaded, removable cap 86 for closing the inlet end 84 when the device is not in use. In addition to preventing spillage and splashing, capping the inlet end 84 during non-use will prevent odor from escaping the container 12.

Figure 4:
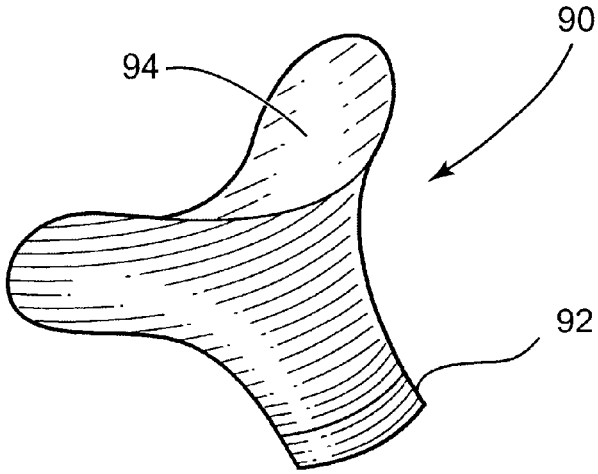
FIG. 4 is a perspective view of an adaptor connectable to the portable waste collection device of the present invention for accommodating female users.

FIG. 4 is a perspective view of an adapter 90 connected to the portable waste collection device 10 for accommodating female users. A lower end 92 of the adapter is internally threaded, like the removable cap 86, for threaded engagement with the inlet end 84 of the container. The upper end 94 of the adapter 90 is generally funnel-shaped and is configured to comfortably conform to the female anatomy during use.

Thus, in operation, a user of the portable waste collection device 10 of the present invention removes the cap 86 and deposits urine into the first container 12 via the inlet conduit 82. As explained above, female users may do so with the funnel-shaped adapter 90 connected to the inlet end 84 of the inlet conduit 82. Then, the user manually pumps flushing solution 26 from the second container 14 into the first container 12 by pressing downwardly on the hand-engaging portion 40 of the second container 14 to compress or collapse the body portion 36 of the second container 14 one or more times to dispense a desired amount of flushing solution 26 into the first container 12. Finally, the user replaces the threaded cap 86.

A method of the present invention for collecting urine in a portable collection device comprises the steps of: providing a collection device 10 having a first container 12 adapted to receive and contain urine, and an adjacent second container 14 having a variable interior volume 24 containing a flushing solution 26 and a discharge port 30 for carrying the flushing 20 solution 26 from the second container 14 to the first container 12; depositing urine in the first container 12 of the collection device; and at least partially collapsing the interior volume 24 of the second container 14 in a manner to pump the desired amount of flushing solution 26 from the second container 14 into the first container 12. Preferably, the step of providing the collection device comprises the steps of providing the second container 14 with a collapsible portion 36 that compresses or collapses to reduce the interior volume 24 of the second container 14. Also, preferably, the step of collapsing the collapsible portion 36 of the second container 14 comprises the steps of manually engaging an upper portion 40 of the second container 14 and pressing downwardly.

In view of the foregoing, it will be seen that the several advantages of the invention are achieved and attained. The embodiments were chosen and described in order to best explain the principles of the invention and its practical application to thereby enable others skilled in the art to best utilize the invention in various embodiments and with various modifications as are suited to the particular use contemplated.

As various modifications could be made in the constructions and methods herein described and illustrated without departing from the scope of the invention, it is intended that all matter contained in the foregoing description or shown in the accompanying drawings shall be interpreted as illustrative rather than limiting. Thus, the breadth and scope of the present invention should not be limited. by any of the above-described exemplary embodiments, but should be defined only in accordance with the following claims appended hereto and their equivalents.

What is claimed is:

1. A portable urine collection device comprising:

a first container having an interior volume adapted to receive and contain urine; and a second container adjacent to the first container, the second container having an interior volume adapted to contain a flushing solution, the second container having a discharge port adapted to permit flushing solution contained in the second container to be discharged from the second container into the first container;

wherein the second container comprises a pump for pumping a desired amount of the flushing solution from the second container into the first container; and wherein a body portion of the second container is collapsible and comprises said pump, said pump being operable by causing the body portion of the second container to at least partially collapse in a manner to reduce the interior volume of the second container and thereby cause the desired amount of the flushing solution to be discharged from the second container into the first container.

2. The portable urine collection device of claim 1 wherein the pump is manually operable.

3. The portable urine collection device of claim 1 wherein the collapsible body portion of the second container has a bellows-like configuration.

4. The portable urine collection device of claim 1 wherein said flushing solution comprises a disinfectant solution.

5. The portable urine collection device of claim 1 wherein said flushing solution comprises a deodorizing solution.

6. The portable urine collection device of claim 1 wherein at least one of the first and second containers is comprised primarily of corrosion-resistant polymeric material.

7. The portable urine collection device of claim 6 wherein at least one of the first and second containers is at least partially translucent so that its contents can be exteriorly monitored.

8. The portable urine collection device of claim 1 further comprising a generally planar metal base plate connected to a lower portion of the collection device and generally coextensive therewith for improved stability of the collection device.

9. The portable urine collection device of claim 1 further comprising an inlet conduit in fluid communication with the interior volume of the first container, the inlet conduit being adapted for receiving urine and conveying the same into the interior volume of the first container.

10. The portable urine collection device of claim 9 further comprising a generally funnel-shaped adaptor connectable to an inlet end of the inlet conduit for accommodating female users of the portable urine collection device.

11. The portable urine collection device of claim 9 further comprising a removable cap for closing an inlet end of the inlet conduit when the portable urine collection device is not in use.

12. The portable urine collection device of claim 1 wherein the first container and the second container are of a unitary construction.

13. A portable urine collection device comprising:

a first container having an interior volume adapted to receive and contain urine; and a second container adjacent to the first container, the second container having a variable interior volume adapted to contain a flushing solution, the second container having a discharge port adapted to permit flushing solution contained in the second container to be discharged from the second container into the first container;

wherein the second container is operable in a manner to cause the variable interior volume of the second container to vary between a first volume and a second volume, the second volume being smaller than the first volume, whereby operation of the second container in a manner to at least partially collapse the interior volume of the second container causes an amount of the flushing solution from the second container to be discharged into the first container.

14. The portable urine collection device of claim 13 wherein at least a portion of the second container is collapsible in a manner to at least partially collapse the interior volume of the second container.

15. The portable urine collection device of claim 14 wherein the collapsible portion of the second container has a bellows-like configuration.

16. The portable urine collection device of claim 13 wherein said flushing solution comprises a disinfectant and deodorizing solution.

17. The portable urine collection device of claim 13 wherein at least one of the first and second containers is comprised primarily of corrosion-resistant polymeric material.

18. The portable urine collection device of claim 17 wherein at least one of the first and second containers is at least partially translucent so that its contents can be exteriorly monitored.

19. The portable urine collection device of claim 13 further comprising a generally planar metal base plate connected to a lower portion of the collection device and generally coextensive therewith for improved stability of the collection device.

20. The portable urine collection device of claim 13 further comprising an inlet conduit in fluid communication with the interior volume of the first container, the inlet conduit being adapted for receiving urine and conveying the same into the interior volume of the first container.

21. The portable urine collection device of claim 20 further comprising a generally funnel-shaped adaptor connectable to an inlet end of the inlet conduit for accommodating female users of the portable urine collection device.

22. The portable urine collection device of claim 20 further comprising a removable cap for closing an inlet end of the inlet conduit when the portable urine collection device is not in use.

23. The portable urine collection device of claim 13 wherein the first container and the second container are of a unitary construction.

24. A method of collecting urine in a portable collection device, the method comprising the steps of:

providing a collection device having a first container adapted to receive and contain urine, and an adjacent second container having a variable interior volume containing a flushing solution and a discharge port for carrying flushing solution from the second container into the first container;

depositing urine in the first container of the collection device; and at least partially collapsing the interior volume of the second container in a manner to pump a desired amount of the flushing solution from the second container into the first container.

25. The method of claim 24 wherein at least a portion of the second container is collapsible, and wherein the step of at least partially collapsing the interior volume of the second container comprises the step of at least partially collapsing the collapsible portion of the second container.

26. The method of claim 25 wherein the step of at least partially collapsing the collapsible portion of the second container comprises the steps of manually engaging an upper portion of the second container and pressing downwardly.

* * * * *